US011517097B2

(12) United States Patent
Lin

(10) Patent No.: US 11,517,097 B2
(45) Date of Patent: Dec. 6, 2022

(54) TELESCOPIC CONTAINER FOR COSMETICS

(71) Applicant: LIBO COSMETICS CO., LTD., Taichung (TW)

(72) Inventor: Hsiao-Yun Lin, Taichung (TW)

(73) Assignee: LIBO COSMETICS CO., LTD., Taichung (TW)

( * ) Notice: Subject to any disclaimer, the term of this patent is extended or adjusted under 35 U.S.C. 154(b) by 0 days.

(21) Appl. No.: 17/166,018

(22) Filed: Feb. 3, 2021

(65) Prior Publication Data

US 2022/0240645 A1 Aug. 4, 2022

(51) Int. Cl.

| | |
|---|---|
| ***B43K 21/027*** | (2006.01) |
| ***A45D 40/02*** | (2006.01) |
| ***A45D 40/12*** | (2006.01) |
| *A45D 40/20* | (2006.01) |

(52) U.S. Cl.

CPC ..... *A45D 40/02* (2013.01); *A45D 40/023* (2013.01); *A45D 40/12* (2013.01); *A45D 2040/207* (2013.01)

(58) Field of Classification Search

CPC ..... A45D 40/02; A45D 40/023; A45D 40/12; A45D 2040/207

USPC ..... 401/55

See application file for complete search history.

(56) References Cited

U.S. PATENT DOCUMENTS

| | | | | |
|---|---|---|---|---|
| 2,043,250 | A * | 6/1936 | Kasdan | A45D 40/02 401/84 |
| 2,071,747 | A * | 2/1937 | Houlihan | A45D 40/02 401/83 |
| 4,182,945 | A * | 1/1980 | McArdle | A45D 40/02 132/318 |
| 2014/0219703 | A1* | 8/2014 | Kim | A45D 40/023 401/59 |

* cited by examiner

*Primary Examiner* — Jennifer C Chiang

(74) *Attorney, Agent, or Firm* — Bruce Stone LLP; Joseph A. Bruce

(57) ABSTRACT

A telescopic container includes a collar, a handle and a cap. The collar is used to contain an object in the form of a stick. The collar includes a stem extending from an external face. The handle movably receives the collar. The handle includes a front end formed with a cutout. The cap is used to cover a section of the handle. The cap includes a rear end formed with a cutout. The cutouts receive the stem when the front end of the handle is in contact with the rear end of the cap.

4 Claims, 8 Drawing Sheets

TELESCOPIC CONTAINER FOR COSMETICS

BACKGROUND OF INVENTION

1. Field of Invention

The present invention relates to cosmetics and, more particularly, to a telescopic container for cosmetics.

2. Related Prior Art

A conventional container for a lipstick includes a collar, a handle and a cap. The collar holds the lipstick in use. A button is formed at an upper end of a stem extending from the collar. The handle movably receives the collar. The handle includes a rear section and a front section. The rear and front sections of the handle can be made in one piece or two. A slit is made in the rear section of the handle. The stem is movable in and along the slit. Thus, a user can operate the button to move the stem along the slit to move the collar, thereby moving the lipstick from the handle. The cap is used for closing the front section of the handle when the lipstick is inserted in the handle. However, the cover does not cover the slit and the look of the container is not aesthetically pleasant.

Another conventional container for a lipstick includes a collar, a tube, a handle and a cap. The collar holds the lipstick in use. A boss is formed on the collar. The tube movably receives the collar. The tube includes a rear section, a front section and a slit in the front section. The boss is movable in and along the slit. The handle receives the rear section of the tube. A user can operate the boss along the slit to move the collar, thereby moving the lipstick from the tube. The cap is used for closing the front section of the tube when the lipstick is inserted in the tube. Thus, the cap covers the slit and the boss. The look of the container is aesthetically pleasant. The boss is small so that the cap does not have to be large to cover the boss. However, it is difficult to operate the boss, which is small.

The present invention is therefore intended to obviate or at least alleviate the problems encountered in the prior art.

SUMMARY OF INVENTION

It is the primary objective of the present invention to provide an aesthetically pleasant and convenient telescopic container for cosmetics.

To achieve the foregoing objective, the telescopic container includes a collar, a handle and a cap. The collar is used to contain an object in the form of a stick. The collar includes a stem extending from an external face. The handle movably receives the collar. The handle includes a front end formed with a cutout. The cap is used to cover a section of the handle. The cap includes a rear end formed with a cutout. The cutouts receive the stem when the front end of the handle is in contact with the rear end of the cap.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
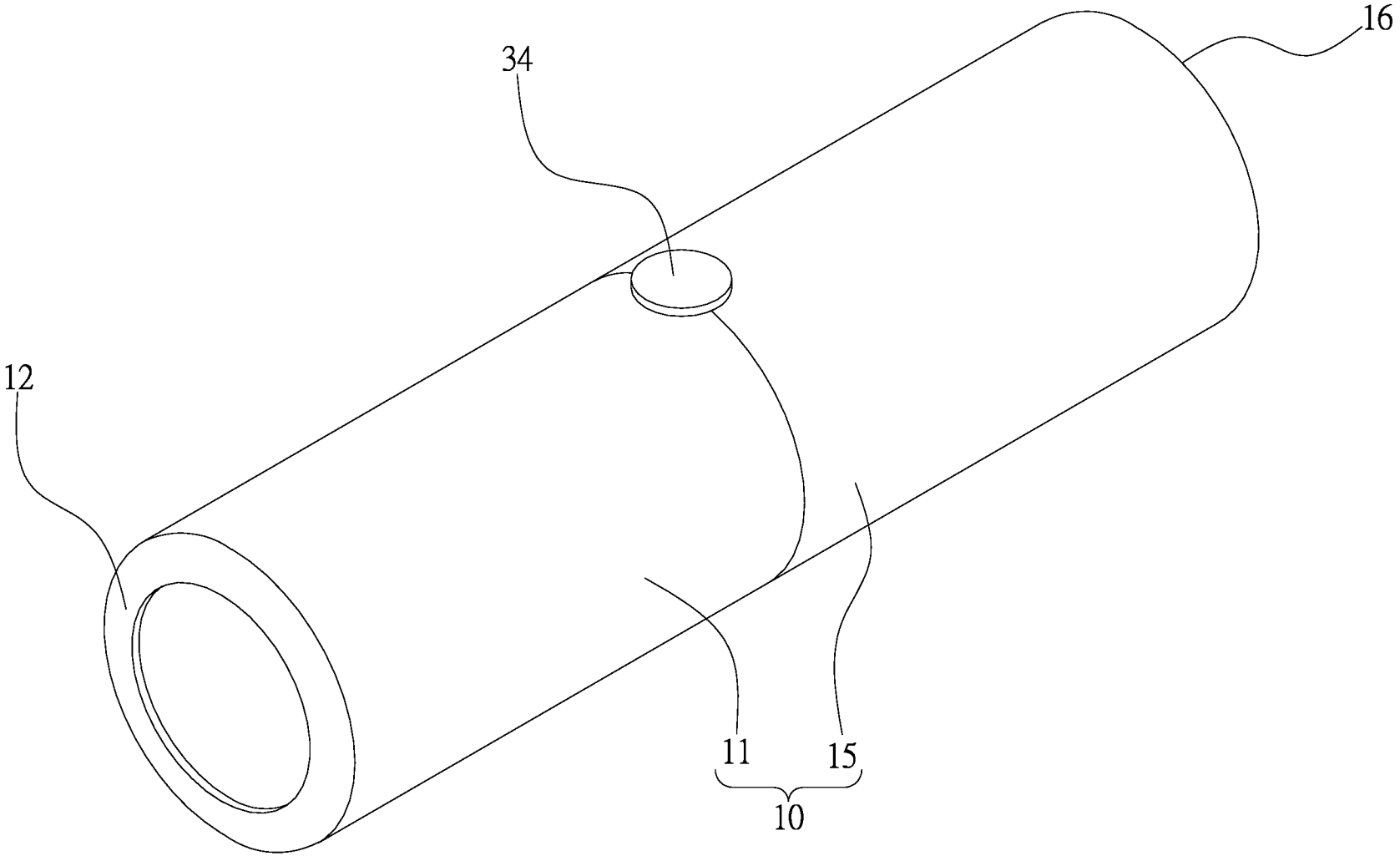
FIG. 1 is a perspective view of a telescopic container for cosmetics according to the preferred embodiment of the present invention.
Figure 2:
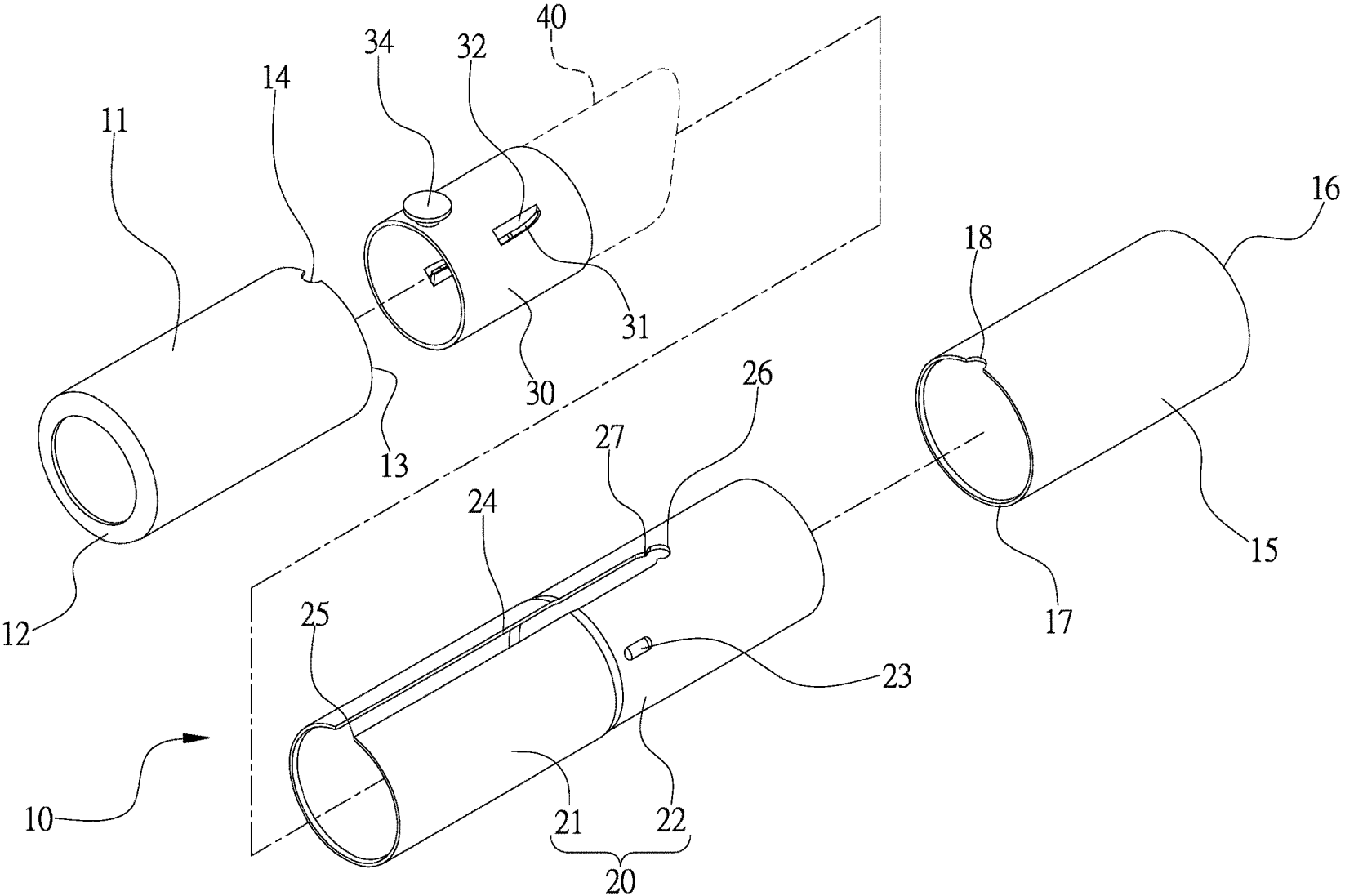
FIG. 2 is an exploded view of the telescopic container shown in FIG. 1.

Referring to FIGS. 1 and 2, a telescopic container 10 includes a handle 11, cap 15, a tube 20 and a collar 30 according to the preferred embodiment of the present invention. The profile of the container 10 is like a circular rod. However, the profile of the container can be like a polygonal rod in another embodiment.

Referring to FIG. 1, the container 10 is closed. That is, the front section 22 of the tube 20 is inserted in the cap 15. A button 34 is located out of a portion of the container 10 where the handle 11 meets the cap 15.

Referring to FIG. 2, the handle 11 includes a rear end 12 and a front end 13. The rear end 12 of the handle 11 is preferably an open end. The front end 13 of the handle 11 is an open end. The handle 11 further includes a cutout 14 in a circular edge at the front end 13 of the handle 11. The cutout 14 is a semi-circular one.

The cap 15 is located at a front end 16 of the container 10. The cap 15 includes a front end 16 and a rear end 17. The front end 16 of the cap 15 is a closed end. The rear end 17 of the cap 15 is an open end. The cap 15 further includes a cutout 18 in a circular edge at the rear end 17 of the cap 15. The cutout 18 is a semi-circular one.

The tube 20 includes a rear section 21 and a front section 22. The diameter of the rear section 21 is larger than the diameter of the front section 22. A slit 24 is longitudinally made in the tube 20. The slit 24 includes an open end 25 at a front end of the rear section 21 of the tube 20 and a closed end 26 at the front section 22 of the tube 20. The slit 24 extends between two longitudinal edges of the tube 20. The tube 20 further includes two protuberances 27 each of which extends from a corresponding one of the longitudinal edges of the tube 20 so that the slit 24 includes a reduced section between the protuberances 27. The protuberances 27 are located closer to the closed end 26 of the slit 24 than the open end 25 of the same. There are preferably bosses 23 formed on an external face of the front section 22 of the tube 20.

The collar 30 preferably includes two longitudinal slots 31 and two longitudinal fins 32. Each of the fins 32 extends along an edge of a corresponding one of the slots 31. The slots 31 and the fins 32 can be made by punching the collar 30 where the collar 30 is a metal collar.

A lipstick 40 includes a pointed or domed end and a flat end. The flat end of the lipstick 40 is inserted in the collar 30. The fins 32 stick in the lipstick 40 so that lipstick 40 is movable together with the collar 30.

Figure 3:
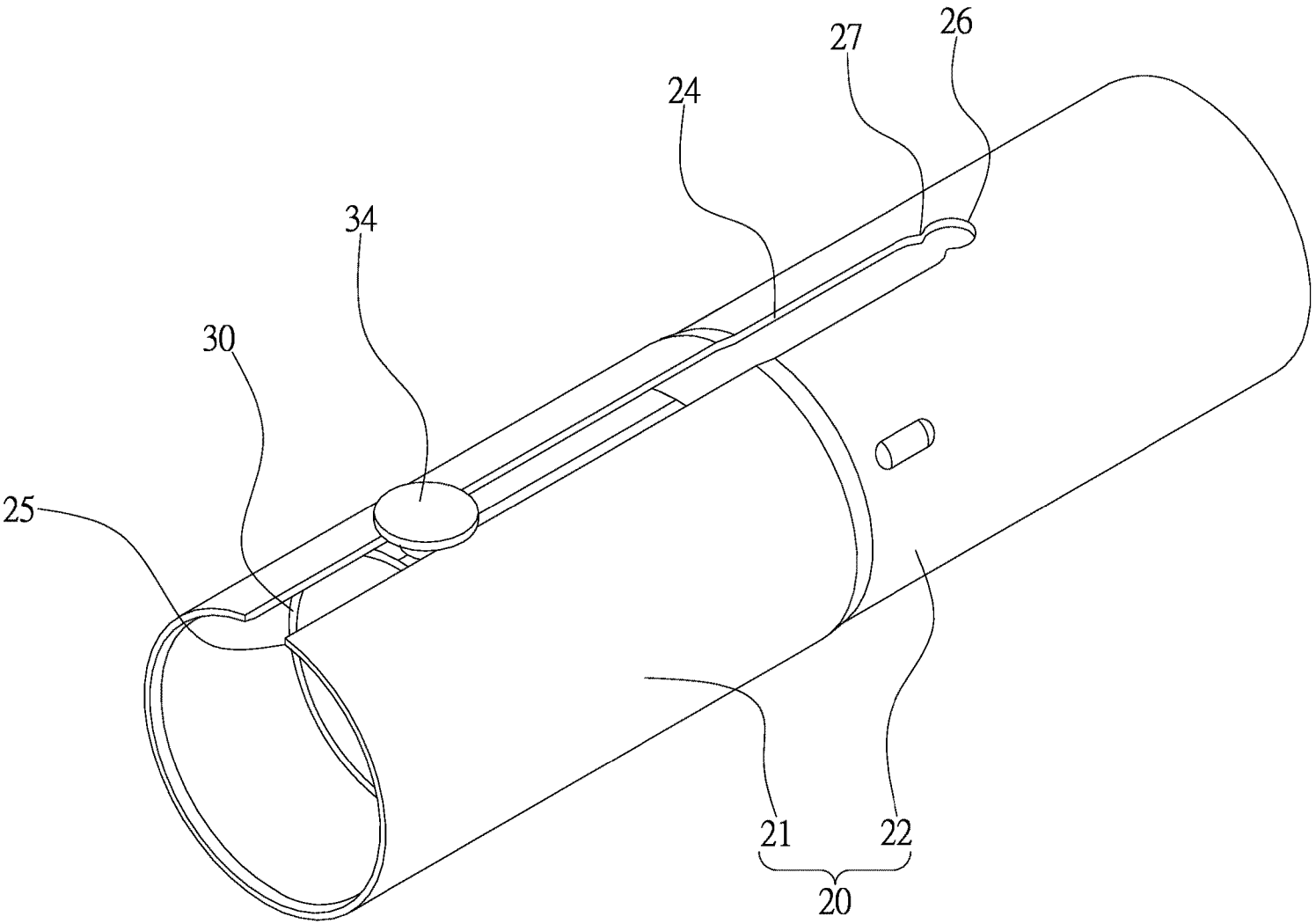
FIG. 3 is a perspective view of a collar inserted in a tube of the telescopic container shown in FIG. 1.

Referring to FIG. 3, the collar 30 is inserted into the rear section 21 of the tube 20 so that the button 34 is moved toward the closed end 26 of the slit 24 from the open end 25. The front section 22 of the tube 20 covers a section of the lipstick 40 (FIG. 2).

Figure 4:
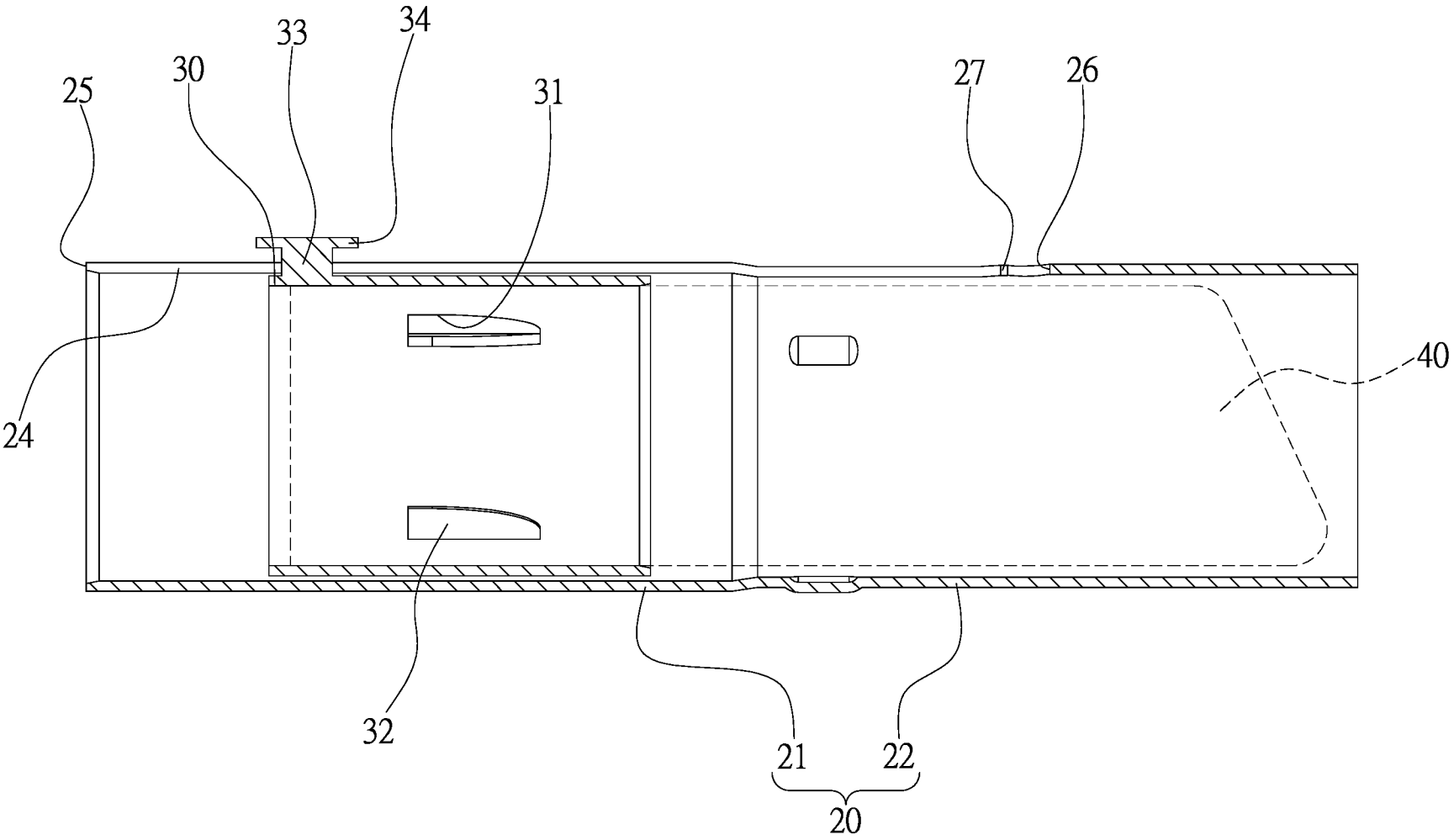
FIG. 4 is a cross-sectional view of the collar and the tube depicted in FIG. 1.

Referring to FIG. 4, the container 10 is opened. That is, the cap 15 is detached from the tube 20. The collar 30 includes a stem 33 extending from an external face in a radial manner. The button 34 is formed on the stem 33. The collar 30, the button 34 and the stem 33 are made in one piece so that button 34 is movable together with the collar 30. The external face of the collar 30 is separated from a lower face of the button 34 by a distance (or the length or height of the stem 33). This distance is larger than the sum of the thickness of the tube 20 and the thickness of the handle 11. This distance is larger than the sum of the thickness of the tube 20 and the thickness of the cap 15.

Figure 5:
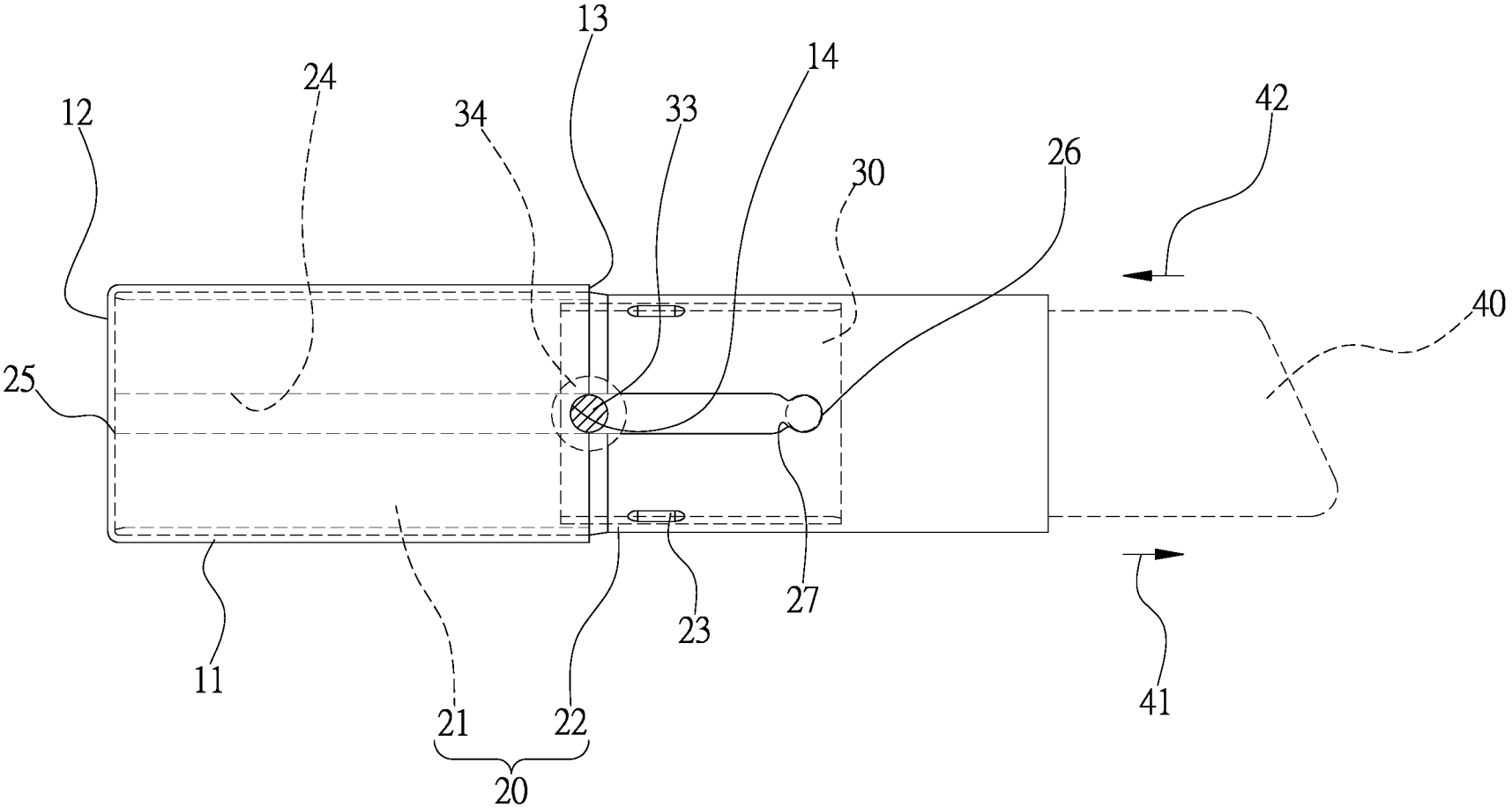
FIG. 5 is a side view of a lipstick partially inserted in the telescopic container shown in FIG. 1.

The stem 33 supports the button 34 so that the button 34 is located above the slit 24. By pushing the button 34, a user moves the collar 30 to and fro in and along the slit 24 via the stem 33 as indicated by two arrowheads 41 and 42 (FIG. 5). Thus, the user moves the lipstick 40 relative to the tube 20. The stem 33 is restrained by the longitudinal edges of the tube 20, which extending by the slit 24, so that the collar 30 and the lipstick 40 are not rotatable relative to the tube 20.

Referring to FIG. 5, the rear section 21 of the tube 20 is connected to the handle 11. The rear section 21 of the tube 20 is C-shaped when it is viewed from a rear end (FIGS. 2 and 3) for including the slit 24. Thus, the rear section 21 of the tube 20 can be compressed by a force so that the rear section 21 of the tube 20 can be inserted in the handle 11. The rear section 21 of the tube 20 is fitted in the handle 11 after the force is removed. There is enough friction between the rear section 21 of the tube 20 and the handle 11 to prevent the handle 11 from movement relative to the tube 20.

The handle 11 and the tube 20 are two individual elements in the preferred embodiment. However, the tube 20 and the handle 11 can be made in one piece in another embodiment.

The circular edge at the front end 13 of the handle 11 is taken as a rear end of the travel of the stem 33 along the slit 24. The cutout 14 is located at the rear end of the travel of the stem 33 along the slit 24. The closed end 26 of the slit 24 is taken as a front end of the movement of the stem 33 along the slit 24.

Referring to FIG. 4, the cap 15 is detached from the tube 20. The stem 33 is at the rear end of the travel along the slit 24. A portion of the stem 33 is inserted in the cutout 14.

By moving the button 34, the user can move the stem 33 toward the front end of the travel along the slit 24 referring to FIG. 5. Before the stem 33 reaches the closed end 26 of the slit 24, the stem 33 contacts protuberances 27. A sound is produced when the user forces the stem 33 past the protuberances 27. The sound is taken as an indicator for reaching the closed end 26 of the slit 24. On hearing the sound, the user stops moving the button 34. Thus, the user will not detach the tube 20 from the handle 11 by mistake.

Figure 6:
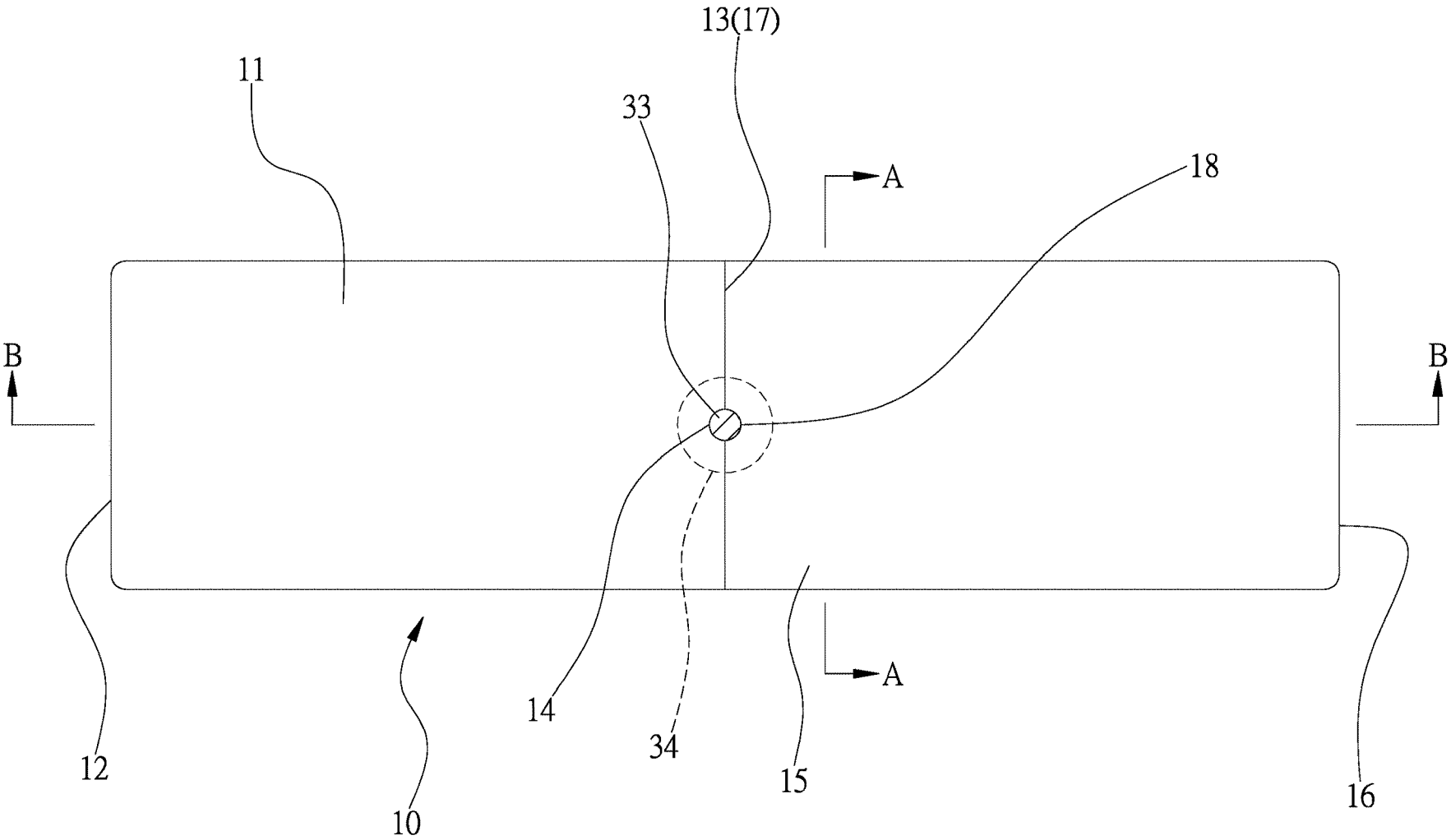
FIG. 6 is a side view of the telescopic container shown in FIG. 1.
Figure 8:
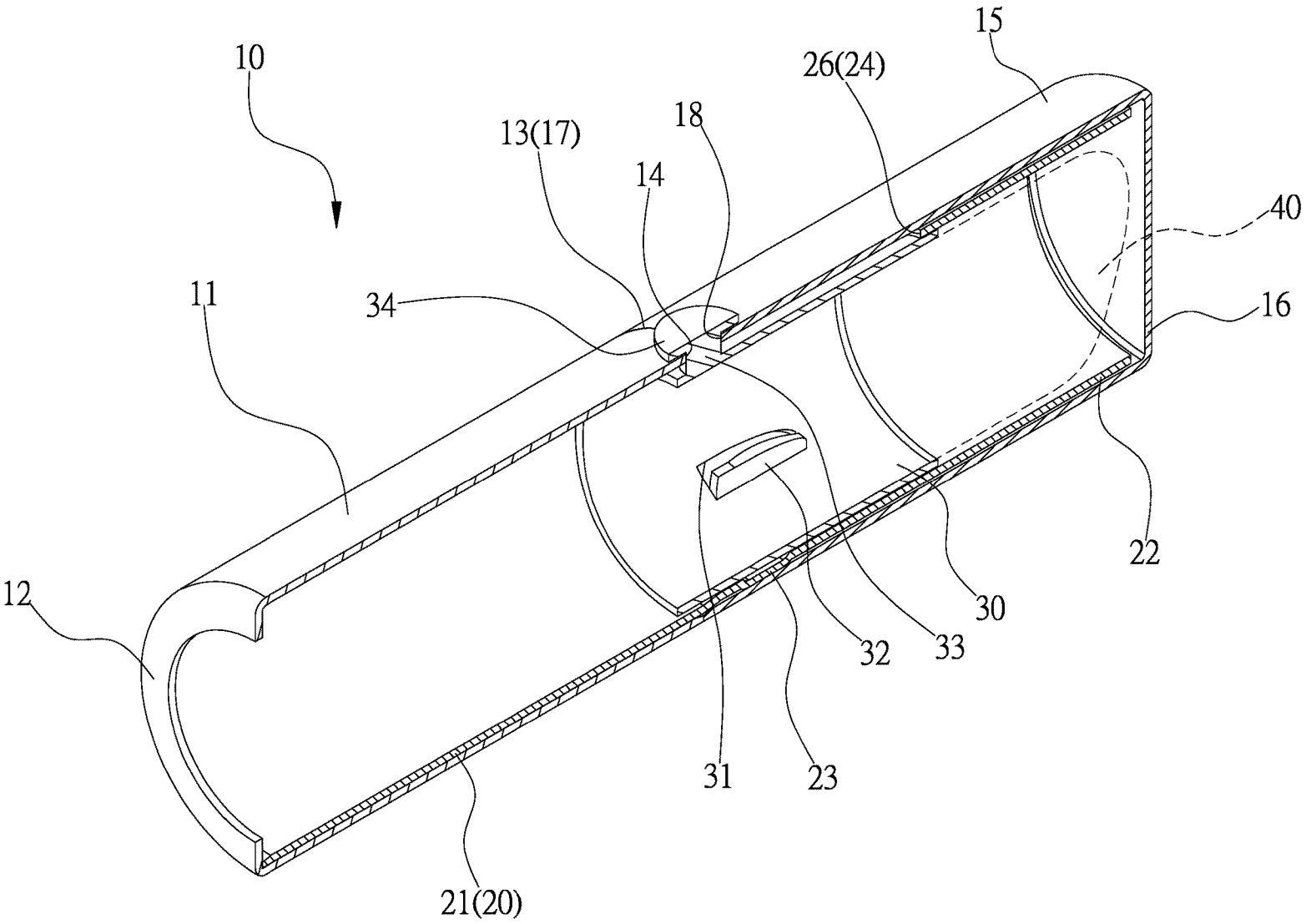
FIG. 8 is a cross-sectional view of the telescopic container taken along a line B-B depicted in FIG. 6.

Referring to FIGS. 6 and 8, the container 10 is closed, i.e., the front section 22 of the tube 20 is inserted in the cap 15. The rear end 17 of the cap 15 is in contact with the front end 13 of the handle 11. The cutout 14 of the cap 15 and the cutout 18 of the handle 11 together become a circular aperture to receive the stem 33 while the button 34 is located out of the handle 11 and the cap 15. The button 34 covers the cutouts 14 and 18 and a section of a gap between the front end 13 of the handle 11 and the rear end 17 of the cap 15.

Figure 7:
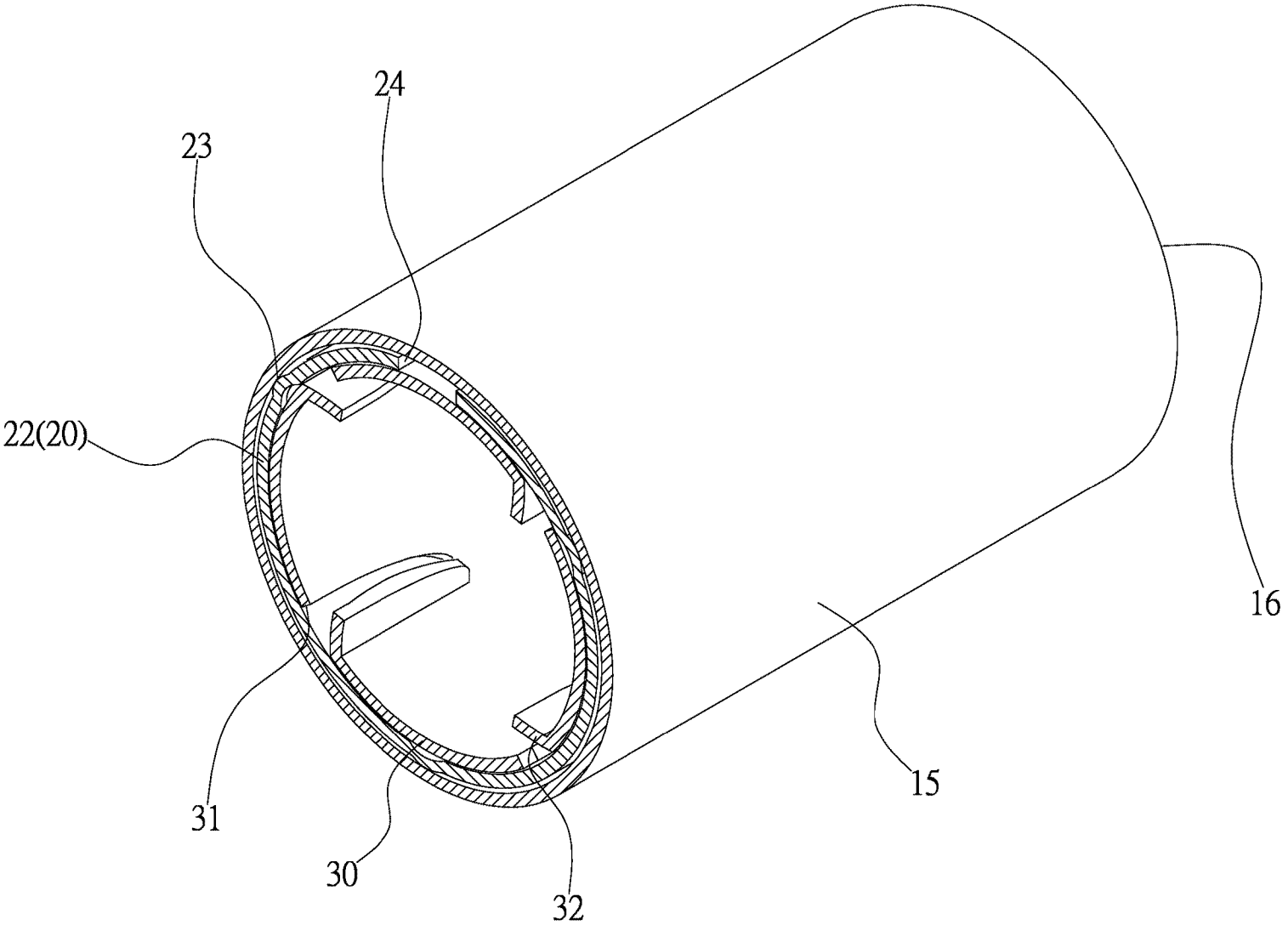
FIG. 7 is a cross-sectional view of the telescopic container taken along a line A-A show in FIG. 6.

Referring to FIG. 7, an internal face of the cap 15 is in contact with the bosses 23, which are formed on the external face of the front section 22 of the tube 20. Thus, there is proper friction between the cap 15 and the tube 20. This friction is not too small to retain the cap 15 on the tube 20 or too large to prevent the user from opening the container 10, i.e., detaching the cap 15 from the tube 20.

The combination of the stem 33 with the protuberances 27 is taken as a fool-proof design to warn the user that the stem 33 is about to reach the front end of the travel along the slit 24. Thus, the user can stop pushing the button 34 to move the stem 33 to prevent detaching the tube 20 from the handle 11.

Advantageously, the button 34 allows easy movement of the lipstick 40, which is held by the stem 33. The container 10 is aesthetically pleasant for the cap 15 covers the slit 24 while the cutouts 14 and 18 receives the stem 33 to allow the button 34 to be located out of the handle 11 and the cap 15.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A telescopic container comprising:

a collar for containing an object in the form of a stick, wherein the collar comprises a stem extending from an external face;

a tube for movably receiving the collar, wherein the tube comprises a rear section, a front section, and a slit made in the rear and front sections of the tube, wherein the slit comprises an open end and a closed end;

a handle for receiving the rear section of the tube, wherein the handle comprises a front end formed with a cutout, wherein the handle covers the open end of the slit, wherein the front end of the handle is an end of travel of the stem along the slit and the closed end of the slit is another end of the travel of the stem along the slit; and a cap for covering the front section of the tube, wherein the cap comprises a rear end formed with a cutout, wherein the cutouts receive the stem when the front end of the handle is in contact with the rear end of the cap.

2. The telescopic container according to claim 1, wherein the collar comprises a button formed at an end of the stem, wherein the button is located out of the handle and the cap and covers the cutouts when the cutouts receive the stem.

3. The telescopic container according to claim 1, wherein the front section of the tube comprises at least one boss formed on an external face, wherein the boss is in contact with an internal face of the cap when the front section of the tube is inserted in the cap.

4. The telescopic container according to claim 1, wherein the slit comprises two protuberances each of which extends from an edge of the slit, wherein the protuberances is located closer to the closed end than to the open end, wherein a sound is produced when the stem is moved past the protuberances by force.

* * * * *